US006052059A

United States Patent [19]

Jaeger

[11] Patent Number: 6,052,059

[45] Date of Patent: Apr. 18, 2000

[54] FUSE PLUG

[75] Inventor: Jim Alfred Jaeger, Mount Cotton, Australia

[73] Assignee: Krone GmbH, Germany

[21] Appl. No.: 09/084,478

[22] Filed: May 22, 1998

[30] Foreign Application Priority Data

May 23, 1997 [DE] Germany ..... 197 22 936

[51] Int. Cl.[7] ..... G08B 21/00

[52] U.S. Cl. ..... 340/638; 340/635; 337/198; 324/550

[58] Field of Search ..... 340/638, 639, 340/635; 335/17; 337/198; 324/550, 507

[56] References Cited

U.S. PATENT DOCUMENTS

| | | | |
|---|---|---|---|
| 3,465,280 | 9/1969 | Paganelli | 340/638 |
| 4,176,902 | 12/1979 | Bernstein | 339/147 |
| 4,499,447 | 2/1985 | Greenberg | 340/638 |
| 4,752,243 | 6/1988 | Meidan | 439/622 |
| 4,772,219 | 9/1988 | Falchetti | 340/638 |
| 4,799,898 | 1/1989 | Schick | 439/418 |
| 5,154,639 | 10/1992 | Knoll et al. . | |
| 5,299,500 | 4/1994 | Lindquist et al. | 102/275.12 |
| 5,311,139 | 5/1994 | Fogal | 340/638 |
| 5,338,224 | 8/1994 | Blanke et al. . | |
| 5,546,267 | 8/1996 | Frederiksen et al. . | |
| 5,574,614 | 11/1996 | Busse et al. . | |
| 5,701,118 | 12/1997 | Hull et al. | 340/638 |

FOREIGN PATENT DOCUMENTS

| | | |
|---|---|---|
| 37 09 875 C2 | 11/1989 | Germany . |
| 39 42 519 A1 | 6/1991 | Germany . |
| 44 37 122 C2 | 6/1991 | Germany . |
| 91 01 599 | 6/1991 | Germany . |
| 39 09 783 C2 | 6/1996 | Germany . |
| 676144 | 7/1952 | United Kingdom . |

*Primary Examiner*—Daniel J. Wu
*Assistant Examiner*—Anh La
*Attorney, Agent, or Firm*—McGlew and Tuttle, P.C.

[57] ABSTRACT

A fuse plug, in particular for terminal blocks in control, regulation and power supply systems, essentially comprising a housing, a fuse-element which is fused upon overshooting of a specific current intensity, contact elements and a display element. Reliable protection against surge voltages is provided. The device ensures that production can be automated with low costs by virtue of the housing (1) being formed from two flat holding halves (2, 3) that can be folded by means of a film hinge 4. The division of the housing is provided in the plane of the plug contacts (5, 6). The fuse-element (7), plug contacts (5, 6) and a display device (19) with a signalling element (15) are arranged in one holding half (2) of the housing (1).

7 Claims, 2 Drawing Sheets

FUSE PLUG

FIELD OF THE INVENTION

The invention relates to a fuse plug, in particular for terminal or connecting blocks in control, regulation and power supply systems with a housing and a fuse-element.

BACKGROUND OF THE INVENTION

DE 44 37 122 C2 describes a safety plug which comprises a housing having a printed circuit board, surge voltage protector, a solder preform which is fused upon overshooting of a specific temperature of the surge voltage protector, a slider, a spring, a ground plate and a signalling element, a spring arm attached to the slider.

The coarse protection is realized in a known way by means of a surge voltage protector. The fail-safe mechanism connected to the surge voltage protector realizes thermal protection in the case of overloading of the surge voltage protector by short-circuiting the telecommunication wires a, b to ground. This shortcircuit mechanism is realized by a slider via which a red signalling element emerges from the plug in a plainly visible fashion at the rear of the plug when a case of surge voltage occurs.

The fused plug is of complicated design and its assembly requires substantial outlay on manipulation and time.

SUMMARY AND OBJECTS OF THE INVENTION

It is the object of the invention to develop a fuse plug for reliably protecting against surge voltages, which is of simplified design and ensures automated production at low cost.

According to the invention, a fuse plug in particular for terminal blocks in control, regulation and power supply systems is provided including a housing, a fuse-element which is fused upon overshooting of a specific current intensity, contact elements and a display element. The housing is formed from two flat holding halves and can be folded by means of a film hinge. This division of the housing is provided in the plane of the plug contacts. The fuse-element, plug contacts and a display device with a signalling element are arranged in one holding half of the housing.

The configuration of plug contacts in conjunction with that of the holding halves of the housing permits the formation of a very flat fuse plug which can be inserted into a connecting block in a fashion which is reliable and easy to manipulate in order to protect pairs of conductors reliably against surge voltages there.

The plug contacts are preferably formed from a contact tongue, a receptacle, rotated by 90° relative to the respective contact tongue, for the fuse-element, and from a test tap. The fuse-element may be arranged transverse to the plug-in direction of the plug. The openings are preferably provided between the webs of the film hinge for the purpose of inserting test pins and for the exit of the signalling element.

The display device may be formed from tripping elements. A label holder may be integrally formed on the housing shoulder. The contact tongues of the plug contacts may be guided in the lower holding half of the housing in a fashion lying flat in grooves of a housing web, the housing web having guide elements via which the fused plug can be detachably latched into the terminal block.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
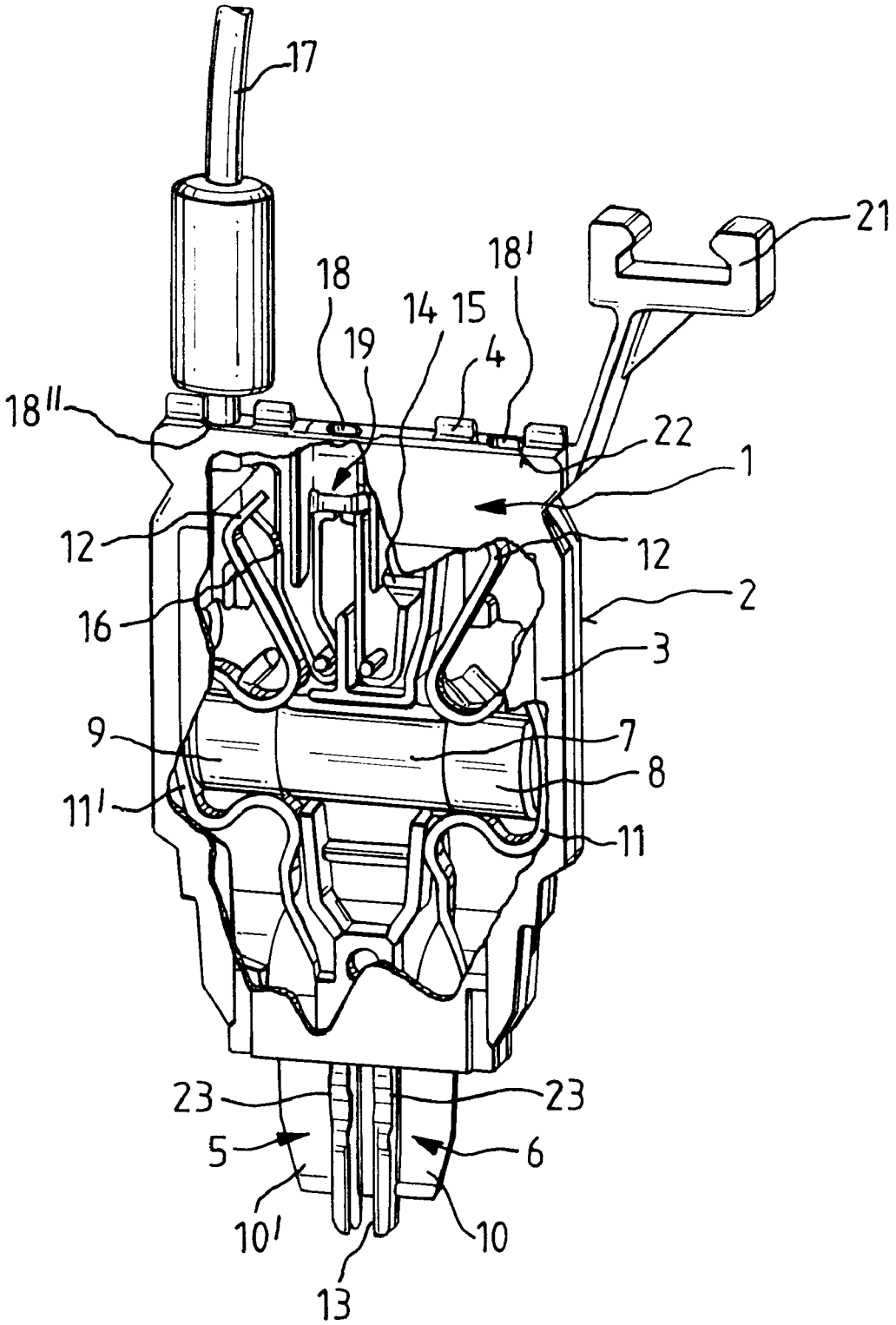
FIG. 1 is a perspective side view of the fuse plug with a cut-away top holding half (cover)

Referring to the drawings in particular, a fuse plug is provided, in particular, as an surge voltage safety plug for application in regulation, control and power supply systems in conjunction with isolating and connecting blocks. The fuse plug provides protection against transient surge voltages and inductive currents.

The way that the significant components of the fuse plug cohere in their design is shown in FIG. 1 in a perspective side view of an opened plug.

According to the representation in FIG. 1, the fuse plug comprises a flat housing 1, which is formed from two holding halves 2, 3 which are foldably connected to one another via one or more web of a film hinge 4. The upper or rear holding half 2 in FIG. 1 has chambers which are formed by webs and into which a fuse-element 7, a display device 19 and plug contacts 5, 6 are inserted. The upper or front holding half 3 in FIG. 2 situated thereabove functions as a cover.

Figure 2:
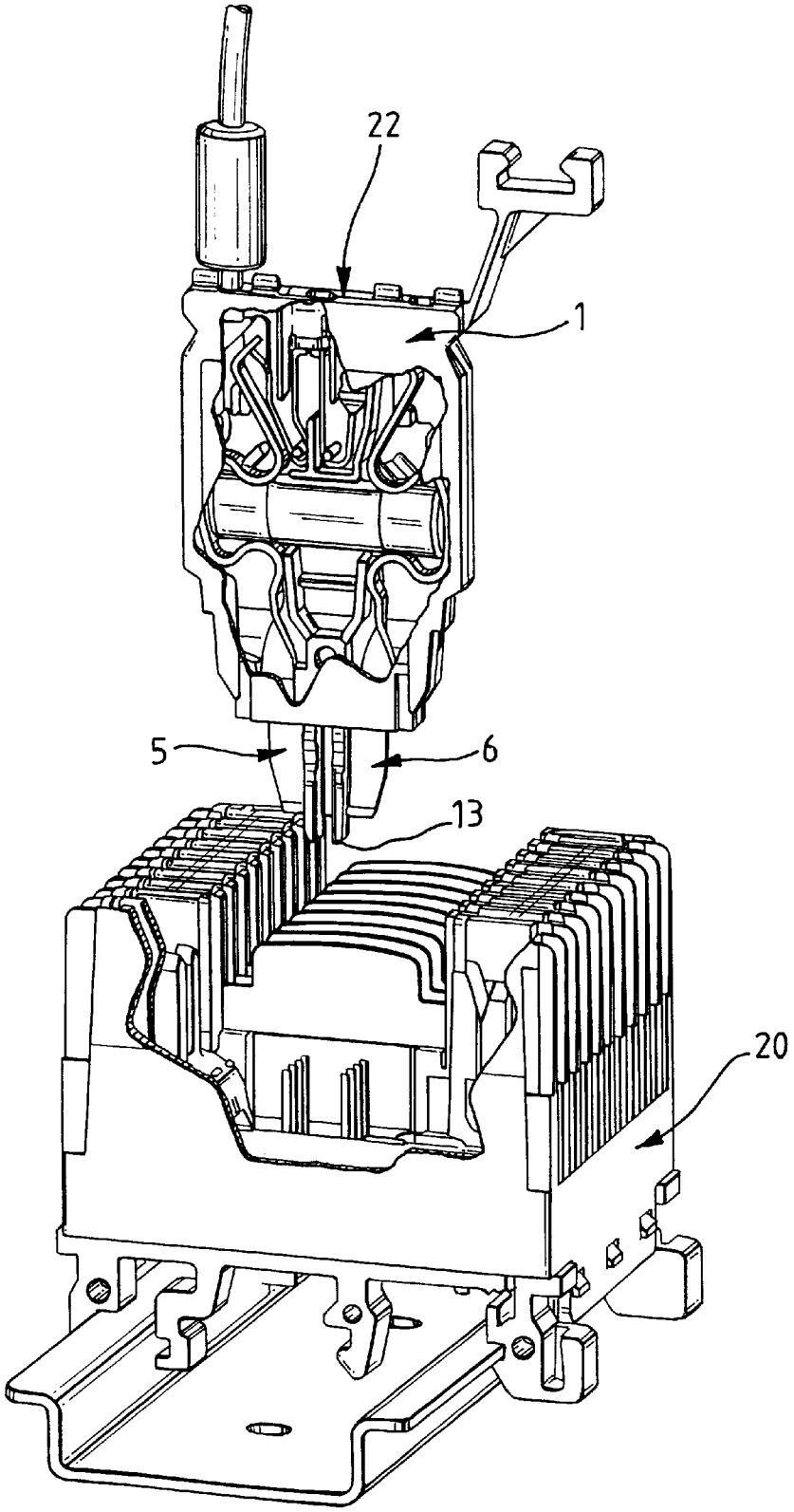
FIG. 2 is a perspective side view of the fuse plug with a cut-away, according to FIG. 1, in a manipulation position relative to a terminal block.

The plug contacts 5, 6 essentially comprise three regions. The first region is formed in each case from a contact tongue 10, 10', which is guided in the lower holding half 2 of the housing 1 in a fashion lying flat in grooves of a housing web 13 which projects from the housing 1 beyond contact tongues 10, 101 and serves to guide the contact tongues 10, 10' in a block 20 (FIG. 2). The second region is formed in a continuation of the contact tongues 10, 10', in each case from a metallic receptacle 11, 11' in the form of an indentation, this indentation being rotated by 90° relative to the respective contact tongue 10, 10'. The third region is formed as an extension to the receptacles 11, 11', in each case as a test tap 12, 12', in the upper section of the fuse plug.

The plug contacts 5, 6 are connected to one another in an electrically conducting fashion via the fuse-element 7, for example comprising a glass tube with two contact caps 8, 9 which are connected to one another via a fusible wire. The fuse-element 7 is inserted with the contact caps 8, 9 into the receptacles 11, 11' of-the plug contacts 5, 6, in a resilient fashion and is easy to replace. When the fuse wire in the fuse-element 7 melts, for example upon the occurrence of surge voltages or impermissibly high currents, the flow of current is interrupted and routed via the display device 19.

The test taps 12, 12, can be reached in a resilient fashion via openings 18', 18" in the housing shoulder 22, for example via a test plug 17. The signalling element 15 of the display device 19 is pushed outwards via a further opening 18 in the housing shoulder 22 and thereby rendered visible if tripping has occurred.

The display device 19 is connected to the test taps 12, 121. The display device 19 is formed from the signalling element 15 and from tripping elements 14, 16.

A label holder 21 is integrally formed on the housing shoulder 22 of the fuse plug and can be used to mark the fuse plug.

An exploded representation of the manipulation of the fuse plug at a terminal block 20 in power supply systems is shown in FIG. 2.

The assembly of the fuse plug can be automated. All the individual parts are designed such that they can be joined manually or by a production line. The housing 1 of the fuse plug can be produced economically as a one-piece injection-molded part.

While specific embodiments of the invention have been shown and described in detail to illustrate the application of the principles of the invention, it will be understood that the invention may be embodied otherwise without departing from such principles.

What is claimed is:

1. A fuse plug, comprising:

a housing having two substantially flat holding halves and a film hinge joining one of said substantially flat holding halves with the other of said flat holding halves, said two substantially flat holding halves and said film hinge being formed of a single molded piece, said folding halves being foldable by means of said film hinge;

a fuse-element which is fused upon overshooting of a specific current intensity;

contact elements including plug contacts, said contact elements being electrically connected by said fuse-element for electrical transmission form one of said contact elements to another of said contact elements in a non-fused state of said fuse element; and a display device with a signaling element, a division of the housing forming said two flat holding halves being provided in a plane of said plug contacts, said fuse-element, plug contacts and said display device with said signaling element being arranged held in one half of the housing.

2. The fuse plug as claimed in claim 1, wherein each of said plug contacts is formed of a contact tongue portion and a fuse receptacle portion rotated by 90° relative to said contact tongue portion to define a fuse-element receptacle, said plug contacts each further including a test tap portion.

3. The fuse plug as claimed in claim 1, wherein said fuse-element is arranged transverse to the plug-in direction of the plug.

4. The fuse plug as claimed in claim 1, wherein said film hinge comprises webs with openings provided between the webs for the purpose of inserting test pins and for the exit of the signaling element.

5. The fuse plug as claimed in claim 1, wherein the display device is formed from tripping elements.

6. The fuse plug as claimed in claim 1, further comprising a label holder integrally formed on the housing shoulder.

7. The fuse plug as claimed in claim 2, wherein said contact tongue portion of the plug contacts are guided in the lower holding half of the housing in a fashion lying flat in grooves of a housing web, the housing web having guide elements via which the fuse plug can be detachably latched into the terminal block.

* * * * *